US008015926B2

(12) United States Patent
Sutter

(10) Patent No.: US 8,015,926 B2
(45) Date of Patent: Sep. 13, 2011

(54) CHAIR FOR A CHAIR LIFT AND CHAIR LIFT

(75) Inventor: Josef Sutter, Bregenz (AT)

(73) Assignee: Innova Patent GmbH, Wolfurt (AT)

( * ) Notice: Subject to any disclaimer, the term of this patent is extended or adjusted under 35 U.S.C. 154(b) by 91 days.

(21) Appl. No.: 12/572,611

(22) Filed: Oct. 2, 2009

(65) Prior Publication Data

US 2010/0089279 A1 Apr. 15, 2010

(30) Foreign Application Priority Data

Oct. 9, 2008 (AT) ..... A 1589/2008

(51) Int. Cl.
*B61C 13/00* (2006.01)

(52) U.S. Cl. ..... 105/149.1; 105/149.2; 104/173.1; 104/173.2

(58) Field of Classification Search ..... 105/149.1, 105/149.2; 104/173.1, 173.2; 297/466, 467, 297/488, 487
See application file for complete search history.

(56) References Cited

U.S. PATENT DOCUMENTS 3,339,496 A * 9/1967 Sneller ..... 104/173.2
3,353,503 A * 11/1967 Pettit ..... 105/150
3,548,753 A * 12/1970 Thurston ..... 104/173.2
3,602,361 A * 8/1971 Cheronis ..... 198/324
3,702,034 A * 11/1972 Pfeiffer ..... 40/320
5,454,326 A * 10/1995 Goirand ..... 104/28
5,664,499 A * 9/1997 Kingsmill ..... 104/28
6,287,211 B1 * 9/2001 Bolliger et al. ..... 472/43
6,427,601 B2 * 8/2002 Albrich ..... 104/87
6,520,573 B2 * 2/2003 Osterle ..... 297/184.11
6,691,624 B2 * 2/2004 Albrich ..... 105/149.2
6,840,179 B2 * 1/2005 Begotti ..... 105/346
7,002,319 B2 * 2/2006 Hinteregger ..... 320/110
7,204,559 B2 * 4/2007 Berra ..... 297/466

(Continued)

FOREIGN PATENT DOCUMENTS

DE 9405017 U1 6/1994

(Continued)

OTHER PUBLICATIONS

European Search Report dated Dec. 10, 2009.

*Primary Examiner* — Joe Morano, IV
*Assistant Examiner* — Jason C Smith
(74) *Attorney, Agent, or Firm* — Laurence A. Greenberg; Werner H. Stemer; Ralph E. Locher

(57) ABSTRACT

Tracks are arranged on the floor of the entry region of a station of the chair lift, the tracks running below and in accordance with the path of movement of the seats of the chair and having a substantially equal width with the corresponding seats. The seat part and/or the backrest of a seat differ/differs with regard to the graphical design from the seat part and/or backrest of an adjacent seat. It is therefore made clear to the passengers, in particular children, how the seat division on the chair has been conceived by the manufacturer and where to stand in the entry region in order to be correctly seated on an approaching seat. If the graphical design of the tracks is identical to the graphical design of the corresponding seat, the effect of the chair according to the invention is reinforced by the unambiguous visual association between the track and seat.

20 Claims, 1 Drawing Sheet

U.S. PATENT DOCUMENTS

| | | | | |
|---|---|---|---|---|
| 7,255,396 | B1 * | 8/2007 | Anikin | 297/284.9 |
| 7,677,671 | B2 * | 3/2010 | Steininger et al. | 297/488 |
| 7,690,313 | B2 * | 4/2010 | Sutter et al. | 104/117.1 |
| 7,802,523 | B2 * | 9/2010 | Moritzhuber et al. | 104/173.1 |
| 2002/0007758 | A1 * | 1/2002 | Albrich | 104/89 |
| 2002/0070599 | A1 * | 6/2002 | Berra | 297/466 |
| 2003/0006639 | A1 * | 1/2003 | Shimizu | 297/423.17 |
| 2003/0136298 | A1 * | 7/2003 | Albrich | 105/329.1 |
| 2006/0232119 | A1 * | 10/2006 | Hinteregger | 297/487 |
| 2007/0095244 | A1 * | 5/2007 | Sutter et al. | 104/112 |
| 2007/0221088 | A1 * | 9/2007 | Hinteregger | 104/178 |
| 2008/0150346 | A1 * | 6/2008 | Hinteregger | 297/488 |
| 2009/0058170 | A1 * | 3/2009 | Switzeny | 297/487 |
| 2009/0151594 | A1 * | 6/2009 | Dur et al. | 104/112 |
| 2010/0089276 | A1 * | 4/2010 | Fischnaller | 105/149.2 |
| 2010/0089277 | A1 * | 4/2010 | Osterle | 105/149.2 |
| 2010/0089278 | A1 * | 4/2010 | Sutter | 105/149.2 |
| 2010/0089279 | A1 * | 4/2010 | Sutter | 105/149.2 |
| 2010/0089280 | A1 * | 4/2010 | Sutterluty | 105/149.2 |
| 2010/0089281 | A1 * | 4/2010 | Sutter | 105/149.2 |

FOREIGN PATENT DOCUMENTS

| | | | |
|---|---|---|---|
| DE | 10134180 | A1 | 1/2003 |
| WO | 2006077474 | A1 | 7/2006 |

* cited by examiner

CHAIR FOR A CHAIR LIFT AND CHAIR LIFT

CROSS-REFERENCE TO RELATED APPLICATION

This application claims the priority, under 35 U.S.C. §119, of Austrian patent application A 1589/2008, filed Oct. 9, 2008; the prior application is herewith incorporated by reference in its entirety.

BACKGROUND OF THE INVENTION

Field of the Invention

The invention relates to a chair lift with at least two stations having an entry and exit region, wherein chairs which are connected to a cable and have at least two seats are movable between the stations, and wherein tracks are arranged on the floor of the entry region. The tracks run below and in correspondence with the path of movement of the seats of a chair.

The invention furthermore relates to a chair of a chair lift having at least two seats each with a seat part and a backrest.

Chair lift stations have an exit and an entry region for the passengers who are to be transported. When a chair enters a station, it passes first through the exit region and then through the entry region. If appropriate, a deflecting region can be provided between the exit and entry regions in order to change the direction of travel of the chair.

It is known to provide the entry region with at least one conveyor belt which is driven in the direction of travel of the chair.

Chairs for chair lifts have at least one seat, generally up to eight or more, for example ten, seats located next to one another. In the entry region, there is the risk of a passenger, upon sitting down, not being correctly positioned on the chair and sitting down at least initially on a transition region from one seat to another. One problem in this case is that the adjacent passenger cannot then correctly position himself either. This problem is critical in particular if a passenger wishes to sit on an outer (edge) seat of the chair and there is no longer a sufficient seat surface available to him/her. Another problem is that, if a sitting position is incorrect, it has to be corrected. This problem is critical in particular if the passenger stands up again and shifts his weight forward. In the situations referred to, falls or other accidents may occur. In addition to the direct risk of injury, attention should also be paid to the fact that, when the chair lift is in operation, a chair will again be approaching, which leads to a new hazardous situation if a person who has fallen is lying on the floor in the path of travel of the chair.

German published patent application DE 101 34 180 A1 describes a chair lift in which tracks are arranged on the floor of the entry region, the tracks running below and in accordance with the path of movement of the seats of a chair and being visually delimited from one another by means of strips. Furthermore, tracks are known in the entry region of chair lifts, said tracks having a central strip. A disadvantage of tracks of this type is that they bring a high risk of being misinterpreted, since the information which is intended to be conveyed to the passenger is not unambiguously clear. It is not obvious to a passenger whether a strip is intended to be a central strip running between his feet, or whether the strip visually delimits a track within which the passenger is to be located.

SUMMARY OF THE INVENTION

It is accordingly an object of the invention to provide a chair lift installation and a lift chair, which overcomes the above-mentioned disadvantages of the heretofore-known devices and methods of this general type and which assists the correct positioning of a passenger when sitting down on the chair, and risks upon entry to the chair are reduced.

With the foregoing and other objects in view there is provided, in accordance with the invention, a chair lift, comprising:

at least two stations (i.e., valley station, mountain station) having an entry region and an exit region, and a cable extending between said at least two stations;

a lift chair connected to said cable for movement between said at least two stations, said lift chair having at least two seats;

said entry region having a floor formed with tracks running below and in accordance with a path of movement of said seats of said chair in said station, wherein one of said tracks has graphical design different from a graphical design of an adjacent said track.

With the above and other objects in view there is also provided, in accordance with the invention, a chair for the foregoing chair lift. The novel chair comprises:

at least two seats each having a seat part and an associated backrest, wherein at least one of said seat part and said backrest differs with regard to a graphical design thereof from an adjacent arranged seat part and/or backrest.

The chair lift according to the invention is characterized in that one track differs with regard to the graphical design from an adjacently arranged track. It is therefore made unambiguously clear to the passengers, in particular to children, how the seat division on the chair has been conceived by the manufacturer and where to stand in the entry region in order to be correctly seated on an approaching seat. The risk of misinterpreting the strips provided in the entry region is eliminated. This increased distinguishability is advantageous particularly since it assists sitting down in the correct position on a seat of the chair. The advantage of tracks of this type is therefore that it is unambiguously indicated to the passenger on the floor in the entry region whether he is standing correctly with regard to an approaching seat.

The correct positioning of the passenger on the chair is an important aspect of the safety in the entry region of the station and during the entire journey from one station to another, since the safety measures provided by the manufacturer are focused on a correct sitting position and are at their most effective in a correct sitting position.

With the chair lift according to the invention, not only are the risks referred to at the beginning in the entry region avoided, but so too are risks which may occur due to an incorrect sitting position during the closing of the safety bar after the entry region. One such risk, for example, is that a protective panel which is arranged on the safety bar and, in the closed position of the safety bar, should be located between the passenger's thighs, presses onto a thigh when the safety bar is closed. In addition, irrespective of whether a protective panel is or is not present, there is the risk of a passenger's leg being pinched by a support tube of a foot rest, the support tube extending downwards between a passenger's legs or between two seats. If the chair according to the invention is equipped with separating elements between the seat parts and, if appropriate, at the outer edge of an outer seat, said separating elements protruding over the upper side of the seat parts, the colored identification of the tracks affords the further advantage that a collision with the separating elements even as a person sits down on a seat can be avoided.

The avoidance of hazardous situations per se for passengers is of particular importance in the field of use of the invention. This is particularly the case when children are being transported, since (potential) hazardous situations may result in unforeseeable reactions in particular when children are involved. With the chair according to the invention and the chair lift according to the invention, children can be safely transported with or without an (adult) escort.

In a preferred embodiment of the invention, the graphically different tracks are substantially identical in width to the corresponding seat.

Within the scope of the invention, the tracks may have an additional central strip.

Within the context of the invention, the tracks may be conveyor belts.

In a preferred embodiment of the invention, a graphical design differing from a neighboring track extends over the entire surface area of the upper side of the track. As an alternative or in addition thereto, graphical designs which extend only partially over a certain length of a track, for example are arranged centrally, can also be provided.

In a simple embodiment of the invention, the track is designed in one color, whereas the adjacent track is designed in another, sufficiently different color. As an alternative or in addition thereto, tracks having multicolored patterns extending entirely (for example a chequered pattern over the full surface area) or only partially (for example a preferably centrally arranged graphic) over the surface of a track may also be provided. For example, graphics such as pictures, symbols, patterns, logos, for example company logos, mascots, comic figures or the like are provided on the tracks.

In a particularly preferred embodiment, the seat part and/or the backrest differ/differs with regard to the graphical design from an adjacently arranged seat part and/or from an adjacently arranged backrest. The seat division on the chair is therefore made clear to the passengers, in particular children.

The graphical design of a seat is preferably uniform, i.e. the graphical design of the seat part and of the backrest of the seat are identical. As an alternative or in addition thereto, the graphical designs of the seat part and backrest of a seat may be similar or related to each other. For example, similar or matching graphics, such as pictures, symbols, patterns, logos, for example company logos, mascots, comic figures or the like, are provided on the seat part and on the backrest. Matching graphics which can be related to each other but which are neither identical or similar may be, for example, two comic figures which, although differing visually, are associated with each other.

If the graphical configuration of the track is identical to the graphical design of the seat part and/or of the backrest of the corresponding seat, the effect of the chair according to the invention is reinforced by the unambiguous visual relationship between track and seat. This may also be achieved by the graphical designs of a track and of the seat part and/or of the backrest of a seat being similar or related to each other.

A graphical design of a seat part and/or of a backrest and/or of a track may be arranged on a support which is connected, such as, for example, adhesively bonded, releasably or non-releasably to the seat part and/or the backrest and/or the track. As an alternative thereto, a graphical design may also be formed directly by the seat part and/or the backrest and/or the track, for example by a surface structure which differs recognizably from the surface structure of the seat part and/or of the backrest and/or of the track arranged next thereto.

The chair according to the invention may be designed with or without a protective hood.

In order to prompt children in particular to sit down on a seat in such a manner that a securing part can be positioned between the thighs, in one embodiment of the invention at least one seat part has, in the region of the front edge thereof, a central region which differs with regard to its graphical design from the regions arranged laterally next thereto.

Other features which are considered as characteristic for the invention are set forth in the appended claims.

Although the invention is illustrated and described herein as embodied in a chair for a chair lift and chair lift, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
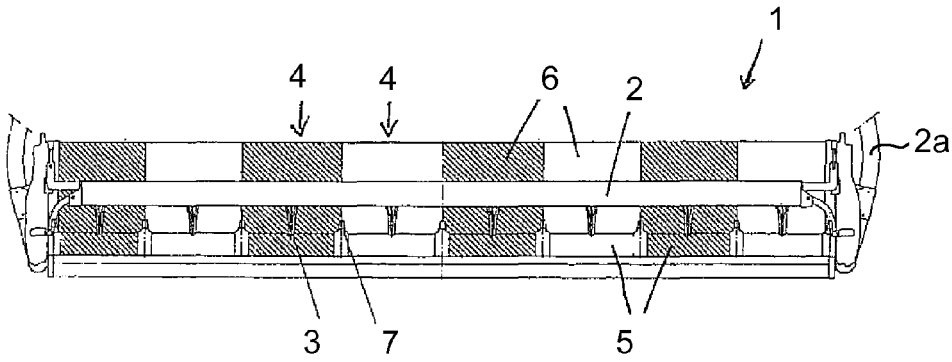
FIG. 1 is an elevation view of an exemplary embodiment of a chair according to the invention.

Referring now to the figures of the drawing in detail and first, particularly, to FIG. 1 thereof, there is shown a chair 1 of a chair lift having a safety bar 2 with protective panels or cams 3. The safety bar 2 may be configured as is customary in the prior art or it may be modified in accordance with my copending patent application Ser. No. 12/572,623 and its counterpart Austrian patent application A 1586/2008, which are herewith incorporated by reference. Additional information regarding the chair may be found in the copending application and in other commonly assigned applications and patents. The safety bar 2 is pivotally mounted on a frame 2*a* which is connected via a joint to a supporting rod, at the upper end of which a clamping device is provided for fastening the chair 1 to a traction cable. The invention is suitably used for different designs of chairs, in particular chairs which can be coupled to the traction cable.

The chair 1 has at least two seats 4—the exemplary embodiment according to FIG. 1 shows eight seats—with a seat part 5 and a backrest 6. In the closed position of the safety bar 2, the protective cams 3 are located in the central region of the seat parts 5 in the region of the front edge thereof and, given a correct seating position of the passengers, between their thighs.

The chairs 1 are conveyed between a valley station, if appropriate via one or more intermediate stations, and a mountain station and back again with the aid of an endless, encircling traction cable. In the process, the chairs 1 can either be decoupled from the traction cable and coupled thereto again in the stations with a clamping device, or it is also possible to fixedly clamp the chairs 1 to the traction cable.

In the embodiment shown in FIG. 1, the seats 4, the respective seat part 5 and the respective backrest 6 differ with regard to their graphical design from an adjacently arranged seat 4. The graphical design of the seat part 5 and of the backrest 6 of a seat 4 is identical in each case here. In the chair 1 shown, the seats 4 are each patterned and not patterned in an alternating manner. Since color contrasts reinforce the visual differentiation between the seats 4, the seats 4 are in each case light and dark in an alternating fashion.

To further assist a correct sitting position, separating elements 7 are arranged between the seat parts 5. The separating elements 7 protrude over the upper side of the seat parts 5. Said separating elements therefore separate the seat parts 5 not only visually from one another but also have the effect that a passenger notices if he/she sits on a transition region from one seat 4 to another.

Figure 2:
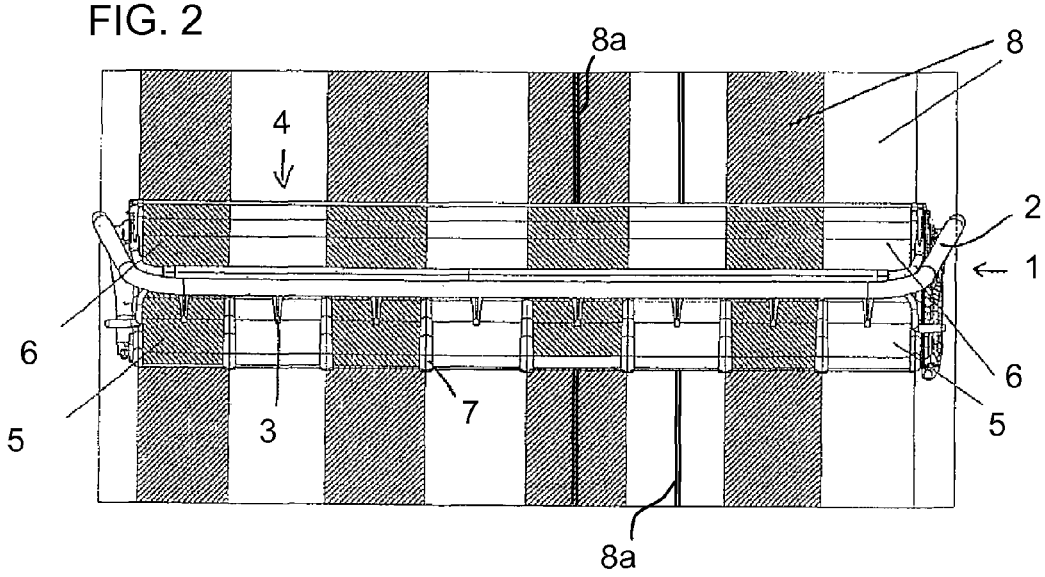
FIG. 2 is a view of the chair of FIG. 1 in an entry region of a station.

In FIG. 2, the chair 1 shown in FIG. 1 is seen in the entry region of a station of a chair lift. Tracks 8 which run below and in accordance with the path of movement of the seats 4 of the chair 1 are arranged on the floor of the entry region. The tracks 8 are tracks 8 which are visually delimited from one another and are substantially identical in width with the corresponding seats 4. The graphical design of each track 8 corresponds to the graphical design of the corresponding seat 4. In this embodiment, a passenger can see particularly readily where to stand in the entry region in order to be correctly seated on a seat 4. The tracks 8 are preferably provided on a conveyor belt. The association and the proper central placement by the passenger are further improved by providing a central strip 8*a* inside the tracks. Two such exemplary central strips 8*a* are illustrated in FIG. 2. The central strips 8*a* are congruently aligned with the travel path of the cams 3 above the tracks 8.

In summary, an exemplary embodiment of the invention can be described as follows: Tracks 8 which run below and in accordance with the path of movement of the seats 4 of the chair 1 and which are substantially identical in width to the corresponding seats 4 are arranged on the floor of the entry region of a station of the chair lift. The seat part 5 and/or the backrest 6 of a seat 4 differ/differs with regard to the graphical design from the seat part 5 and/or backrest 6 of an adjacently arranged seat 4. It is therefore made clear to the passengers, in particular children, how the seat division on the chair 1 is conceived by the manufacturer and where to stand in the entry region in order to be correctly seated on an approaching seat 4.

If the graphical design of the tracks 8 is identical to the graphical design of the corresponding seat 4, the effect of the chair 1 according to the invention is reinforced by the unambiguous visual relationship between the track 8 and seat 4.

The invention claimed is:

1. A chair lift, comprising:

at least two stations having an entry region and an exit region, and a cable extending between said at least two stations; and a lift chair connected to said cable for movement between said at least two stations, said lift chair having at least two seats;

said entry region having a conveyor belt driven in a direction of travel of said lift chair; and said conveyor belt formed with tracks running below and in accordance with a path of movement of said seats of said lift chair in said station, wherein one of said tracks has graphical design different from a graphical design of an adjacent one of said tracks.

2. The chair lift according to claim 1, wherein said tracks are substantially identical in width to the corresponding said seats.

3. The chair lift according to claim 1, wherein said tracks have a central strip.

4. The chair lift according to claim 1, wherein said graphical design that differs from an adjoining said track extends at least partially over an entire upper surface of said track.

5. The chair lift according to claim 1, wherein said tracks that differ with regard to said graphical design from an adjacent said track have a different surface structuring.

6. A chair for a chair lift according to claim 1, comprising:

at least two seats each having a seat part and an associated backrest, wherein at least one of said seat part and said backrest differs with regard to a graphical design thereof from an adjacent said seat part and/or backrest.

7. The chair according to claim 6, wherein a graphical design differing from an adjacent said seat part and/or backrest extends at least partially over an upper side of said seat part and/or of said backrest.

8. The chair according to claim 6, wherein said seat part and said backrest of a given said seat have substantially identical graphical designs.

9. The chair according to claim 6, wherein the graphical designs of said seat part and of said backrest of a given said seat are similar to one another.

10. The chair according to claim 6, wherein the graphical designs of said seat part and of said backrest of a given said seat can be associated with each other.

11. The chair according to claim 6, wherein a graphical configuration of at least one of said seat part and said backrest of a given said seat and of a corresponding said track is identical.

12. The chair according to claim 6, wherein the graphical designs of at least one of said seat part and said backrest of a given said seat and of a corresponding said track are similar.

13. The chair according to claim 6, wherein the graphical designs of at least one of said seat part and said backrest of a given said seat and of a corresponding said track can be associated with each other.

14. The chair according to claim 6, which comprises a safety bar formed with securing elements mounted thereon, said securing elements extending in a direction toward a center of a front edge of a respective said seat part in a closed position of said safety bar.

15. The chair according to claim 14, wherein said securing elements are protective cams for placement between the thighs of a passenger seated on the chair.

16. The chair according to claim 14, which comprises a footrest supported on said safety bar by way of a support tube, said support tube extending in the central region in front of said seat downward from said safety bar to said footrest.

17. The chair according to claim 6, which comprises separating elements disposed between said seat parts and projecting above an upper side of said seat parts.

18. The chair according to claim 6, wherein said seat part has a front edge with a central region differing with regard to a graphical design thereof from regions disposed laterally thereof.

19. The chair lift according to claim 1, wherein:

said lift chair includes at least a first seat and a second seat each having a seat part and an associated backrest;

at least one of said seat part and said backrest of said first seat has a graphical design that is different from that of said second seat;

at least one of said seat part and said backrest of said first seat has a graphical configuration corresponding to said graphical design of said one of said tracks; and at least one of said seat part and said backrest of said second seat has a graphical configuration corresponding to said graphical design of said adjacent one of said tracks.

20. A chair lift, comprising:

at least two stations having an entry region and an exit region, and a cable extending between said at least two stations; and a lift chair connected to said cable for movement between said at least two stations, said lift chair having at least two seats;

said entry region having a floor formed with tracks running below and in accordance with a path of movement of said seats of said lift chair in said station, wherein one of said tracks has graphical design different from a graphical design of an adjacent one of said tracks;

wherein said tracks are conveyor belts driven in a direction of travel of said lift chair.

* * * * *